US005117807A

United States Patent [19]

Graulich

[11] Patent Number: 5,117,807

[45] Date of Patent: Jun. 2, 1992

[54] PROTECTIVE COVER FOR AN OVEN DOOR

[76] Inventor: Debra J. Graulich, P.O. Box 8387, St. Thomas, V.I. 00801

[21] Appl. No.: 345,659

[22] Filed: May 30, 1989

[51] Int. Cl.[5] ..... F24C 15/04

[52] U.S. Cl. ..... 126/190; 126/42; 126/221; 160/388; 160/237

[58] Field of Search ..... 126/190, 201, 211, 214 D, 126/221, 42; 160/352, 13, DIG. 13, 237, 388

[56] References Cited

U.S. PATENT DOCUMENTS 2,337,332 12/1943 Lange ..... 126/190
3,529,881 9/1970 Kaldenberg ..... 126/190 X
4,527,540 7/1985 Ryan et al. ..... 126/201 X

FOREIGN PATENT DOCUMENTS 298858 1/1989 European Pat. Off. ..... 126/42

*Primary Examiner*—Larry Jones
*Attorney, Agent, or Firm*—Sixbey, Friedman, Leedom & Ferguson

[57] ABSTRACT

A rectangular shaped padded cloth cover for the outside of an oven door is constructed by securing together several pieces of material to provide the thickness or padding necessary to establish a protective barrier. Loops are provided to secure the cover to the oven door handle, and magnets, adhesive, or other fastening devices hold the cover to the door when the door is opened. The cover protects against injuries resulting from casual contact with a hot oven door, and also serves a decorative function.

19 Claims, 1 Drawing Sheet

PROTECTIVE COVER FOR AN OVEN DOOR

BACKGROUND OF THE INVENTION

This invention relates to protective coverings and specifically to a covering to provide heat protection from the oven door area.

SUMMARY OF THE INVENTION

The present invention is a rectangular shaped padded cloth cover for the outside of an oven door constructed by securing together several pieces of material to provide the thickness or padding necessary to establish a protective barrier. Loops are provided to secure the cover to the oven door handle, and magnets, adhesive, or other fastening devices hold the cover to the door when the door is opened. The cover protects against injuries resulting from casual contact with a hot oven door, and also serves a decorative function.

DESCRIPTION OF THE PREFERRED EMBODIMENTS

Figure 1:
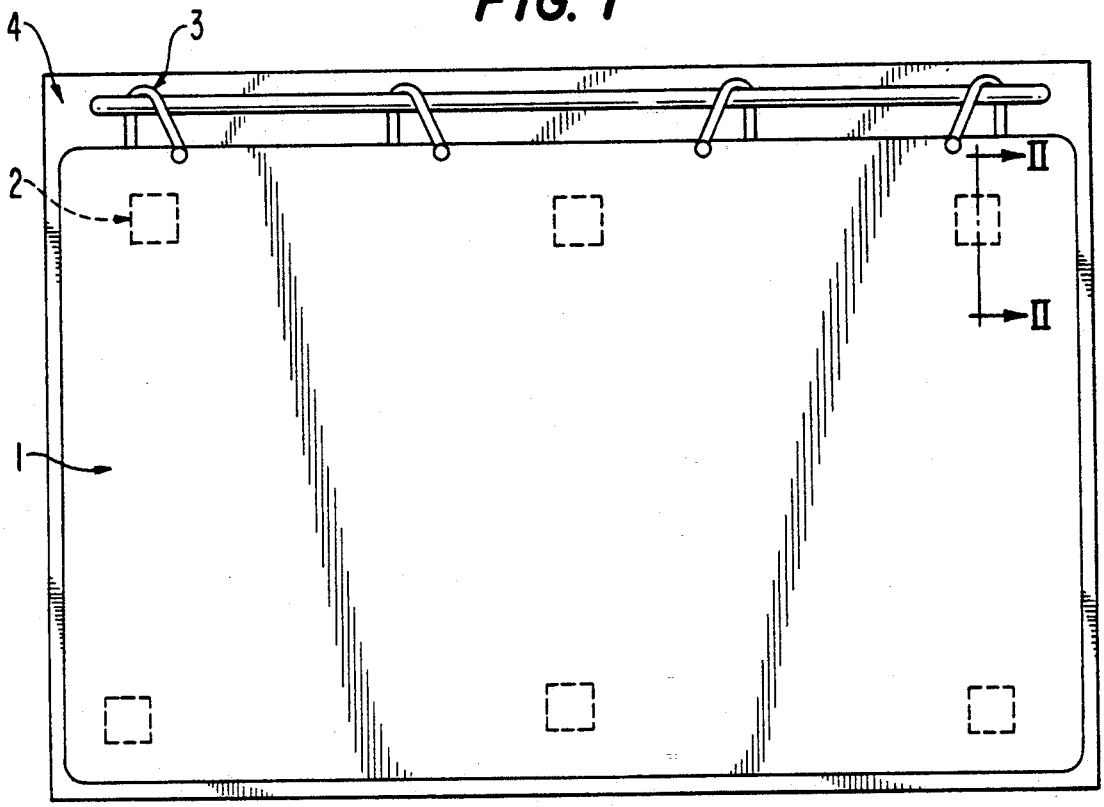
FIG. 1 is a front view of an oven door cover according to the present invention installed on an oven door.
Figure 2:
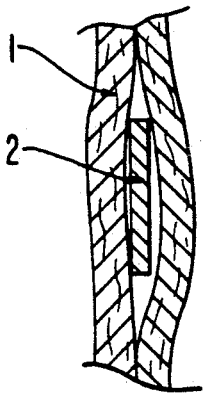
FIG. 2 is a cross-sectional view of the oven door cover of FIG. 1 showing the placement of fastening devices in the body of the oven door cover.

As shown in FIG. 1, the oven door cover of the present invention is a rectangular shaped padded cloth cover for oven doors. It is created by securing pieces of material together, providing enough thickness or padding to establish a protective barrier 1. It uses a combination of attaching devices 3 at the top of the door and magnets or other fastening devices 2 placed within the body of protective barrier 1 to hold it in place on the oven door 4. Placement of the fastening devices 2 within the body of protective barrier 1 is shown in FIG. 2. Protective barrier 1 can be made to fit all oven door sizes. It is designed to be placed on the outside of the oven door 4. The adhesive or magnets keep the protective barrier 1 from dropping on the floor when the door 4 is opened. Protective barrier 1 is designed to protect against, but not prevent, burns or injuries through casual contact with a hot oven door 4. While the above description contains a specific application, it is not limited to a heat protector. Many other uses can be made of the present invention, such as a decorative piece in the room, a protector of the door 4 itself (against scratches, stains, the elements, etc.) It can help catch spills from the oven or stove top, if part of the overall unit. Protective barrier 1 can also act as a coverup for an old or damaged door 4.

In conclusion, the oven door cover of the present invention is a simple but effective device to add decor and protection to one of the most dangerous appliances in the kitchen.

I claim:

1. A protective cover for a front surface of an oven door, comprising:

protective barrier means including padding for preventing direct contact of persons and objects with the front surface of the oven door, said protective barrier means operating to reduce thermal energy conduction between the front surface of the oven door and said persons and objects;

attaching means connected to the protective barrier means for attaching said protective barrier means to the oven door such that the oven door can be opened without removal of said protective barrier means and such that said protective barrier means moves in concert with said oven door during opening and closing of the door;

wherein the attaching means include loop means extending from an upper portion of the protective barrier means around a handle projecting from the oven door to support the protective barrier means.

2. The cover of claim 1 wherein a plurality of said loop means are provided in linear spaced relationship along an upper portion of the protective barrier means and adapted for attachment to an oven door handle extending horizontally across a substantial part of the oven door.

3. The cover of claim 2 wherein the attaching means further includes proximity maintaining means connected with the protective barrier means for holding the protective barrier means in contact with the front surface of the oven door during movement of the door.

4. The cover of claim 3 wherein the proximity maintaining means comprise magnets.

5. The cover of claim 4 wherein the magnets are placed within the body of the protective barrier means.

6. The cover of claim 3 wherein the proximity maintaining means comprise adhesives.

7. The cover of claim 1 wherein the protective barrier means has two sides, a decorative visible side which can be viewed from an observation position in front of the oven when the barrier means is installed on the oven door and a hidden side which cannot be viewed from said observation position.

8. The cover of claim 1 wherein the protective barrier means is a fabric shield.

9. The cover of claim 8 wherein the fabric shield is comprised of a plurality of pieces of material arranged in layers to provide padding.

10. The cover of claim 9 wherein the fabric shield has dimensions which are determined with reference to the particular oven door.

11. A protective cover for a front surface of an oven door, comprising:

protective barrier means of opaque flexible fabric construction for preventing direct contact of persons and objects with the front surface of the oven door, said protective barrier means sized to substantially cover the front surface of the oven door and operating to reduce thermal energy conduction between the front surface of the oven door and said persons and objects;

attaching means connected to the protective barrier means for selectively attaching said protective barrier means to the front surface of the oven door such that the oven door can be opened without removal of said protective barrier means and such that said protective barrier means maintains a substantially fixed relationship with said oven door during opening and closing of the door.

12. The cover of claim 11 wherein the protective fabric barrier means has two sides, a decorative visible side which can be viewed from an observation position in front of the oven when the barrier means is installed on the oven door and a hidden side which cannot be viewed from said observation position.

13. The cover of claim 11 wherein the attaching means include loop means extending from an upper portion of the protective fabric barrier means around a handle projecting from the oven door to support the protective barrier means.

14. The cover of claim 13 wherein a plurality of said loop means are provided in linear spaced relationship along an upper portion of the protective fabric barrier means and adapted for attachment to an oven door handle extending horizontally across a substantial part of the oven door.

15. The cover of claim 11 wherein the attaching means includes a plurality of spaced proximity maintaining means connected with the protective fabric barrier means for holding the protective fabric barrier means against the front surface of the oven door during oven operation.

16. The cover of claim 15 wherein the spaced proximity maintaining means are magnets.

17. The cover of claim 15 wherein the spaced proximity maintaining means are adhesives.

18. The cover of claim 11 wherein the protective fabric barrier means is formed from several pieces of fabric secured together to form a desired thickness.

19. The protective cover of claim 11 wherein the protective barrier means is constructed from multiple layers of flexible material, and the attaching means comprise magnets mounted between said layers.

* * * * *